US006180170B1

(12) United States Patent
Grossmann et al.

(10) Patent No.: US 6,180,170 B1
(45) Date of Patent: Jan. 30, 2001

(54) DEVICE AND METHOD FOR PREPARING AND/OR COATING THE SURFACES OF HOLLOW CONSTRUCTION ELEMENTS

(75) Inventors: Valentin Grossmann, Pasenbach; Horst Pillhoefer, Roehrmoos; Martin Thoma, Munich, all of (DE)

(73) Assignee: MTU Motoren- und Turbinen-Union Muenchen GmbH, Munich (DE)

( * ) Notice: Under 35 U.S.C. 154(b), the term of this patent shall be extended for 0 days.

(21) Appl. No.: 09/125,655

(22) PCT Filed: Feb. 26, 1997

(86) PCT No.: PCT/EP97/00903

§ 371 Date: Aug. 21, 1998

§ 102(e) Date: Aug. 21, 1998

(87) PCT Pub. No.: WO97/32054

PCT Pub. Date: Sep. 4, 1997

(30) Foreign Application Priority Data

Feb. 29, 1996 (DE) ..... 196 07 625

(51) Int. Cl.[7] ..... C23C 16/08

(52) U.S. Cl. ..... 427/237; 427/239; 427/255.31; 427/255.39; 427/248.1; 427/253; 118/728; 118/DIG. 10; 118/DIG. 11

(58) Field of Search ..... 118/715, 719, 118/724, 726, 728, DIG. 10, DIG. 11; 427/250, 252, 253, 255.17, 255.19, 237, 238, 239, 248.1, 255.31, 255.39

(56) References Cited

U.S. PATENT DOCUMENTS 4,698,241 * 10/1987 Roberson ..... 427/234
5,071,678 12/1991 Grybowski .
5,077,140 * 12/1991 Luthra et al. ..... 427/452
5,215,785 * 6/1993 Strasser et al. ..... 427/252
5,221,354 6/1993 Rigney .
5,368,888 * 11/1994 Rigney ..... 427/253
5,693,368 * 12/1997 Ackerman et al. ..... 427/250
5,866,271 * 2/1999 Stueber et al. ..... 427/250
5,904,957 * 5/1999 Christin et al. ..... 427/248.1

FOREIGN PATENT DOCUMENTS 4035789 6/1991 (DE) .
4119967 9/1992 (DE) .
60-149771 8/1985 (JP) .
8127877 * 5/1996 (JP) .

* cited by examiner

*Primary Examiner*—Shrive Beck
*Assistant Examiner*—Bret Chen
(74) *Attorney, Agent, or Firm*—W. F. Fasse; W. G. Fasse

(57) ABSTRACT

In a method for preparing and/or coating the surfaces of metallic hollow structural elements that have at least two connection openings between their outer and inner surfaces, first and second reaction gas mixtures (I, II) are prepared by reaction gas sources for treating the outer and inner surfaces of the hollow structural elements. The first reaction gas mixture (I) is guided over the outer surfaces and thereafter over the inner surfaces of the structural elements, and then the second reaction gas mixture (II) is guided over the inner surfaces and thereafter over the outer surfaces of the structural elements. An apparatus for carrying out the method includes a reaction vessel enclosing an outer reaction space, a central holding pipe arranged in the reaction vessel and enclosing an inner space, and hollow support arms removably attached on the holding pipe to extend radially outwardly therefrom. Each structural element is mounted on a hollow support arm so that one of the connection openings communicates with the inner space through the hollow support arm and the other one of the connection openings communicates with the outer reaction space.

26 Claims, 3 Drawing Sheets

DEVICE AND METHOD FOR PREPARING AND/OR COATING THE SURFACES OF HOLLOW CONSTRUCTION ELEMENTS

This application is a 371 of PCT/EP97/00903 filed Feb. 26, 1997.

FIELD OF THE INVENTION

The invention relates to an apparatus and a method for preparing and/or coating the surfaces of metallic hollow workpieces or structural elements, which comprise at least two connection openings between their outer and inner surfaces.

BACKGROUND INFORMATION

EP 0,349,420 discloses a method with an apparatus for the preparation and/or coating of the surfaces of metallic hollow structural elements, which comprise at least two connection openings between their outer and inner surfaces, especially for hollow blades in the field of turbine engine construction. In the disclosed method and apparatus, a cleaning gas mixture or a coating gas mixture is generated beneath a blade in a reaction space. The blade hangs in the reaction space, from which the outer surfaces may be cleaned or coated. The reaction gas first flows over the outer surfaces in one direction and then flows through a first opening in the hollow blade into the hollow spaces and past the inner surfaces, and finally flows out of the hollow spaces through a second opening in the hollow blade into an exhaust conduit for removal or return flow of the residual gases of the reaction gas.

Such apparatus and methods have the disadvantage that the concentration of individual reaction components, which are contained in the reaction gas and which react with the surfaces, diminishes along the path over the outer surfaces, the first opening, the inner surfaces, and up to the outlet out of the second opening, to such an extent that substantial reaction differences arise between the outer and inner surfaces and over the course of the inner surfaces.

The reaction differences between the outer and inner surfaces are partially overcome by measures as are described in the patents DE 4,035,789 and DE 4,119,967. However, it can be determined that the differences over the course of the inner surfaces from the entry into the hollow spaces up to the point of flowing out of the hollow spaces cannot be substantially improved using the prior methods. Moreover, the improved methods and apparatus have the disadvantage that they require retort structures that are constructed in an extremely complex and only slightly variable manner, and appear to be unsuitable for use in mass production.

A further essential disadvantage of the prior art is that the known apparatus and methods do not permit the use of different gas sources for the treatment of the outer and inner surfaces.

SUMMARY OF THE INVENTION

Objects of the invention are to overcome the disadvantages of the prior art. These objects are achieved according to the invention, insofar as a method is involved, by the following method steps:

a) preparing at least first and second reaction gas mixtures (I, II) by means of reaction gas sources for treating the outer and inner surfaces of the hollow structural elements, b) passing the first reaction gas mixture (I) over the outer surfaces and then over the inner surfaces of the structural elements, c) passing the second reaction gas mixture (II) over the inner surfaces and then over the outer surfaces of the structural elements.

In comparison to the prior methods, this present inventive method has the advantage, of providing the same uniform reaction effect of the reaction gases on and completely along the inner surfaces of the same hollow structural elements, whereby it achieves a greater uniformalization of the reaction results both for a preparation such as the reduction of sulfide-based or oxide-based surface contaminants as well as for a coating of the inner surfaces with protective layers that provide protection against oxidation, corrosion or sulfidation. In the event that the inner surfaces form channels, as are known in hollow turbine or compressor blades, then twice the channel length can be cleaned or coated in comparison to the cleaning or coating using typical methods, since the reaction gases can flow through the hollow spaces not only in one direction, but rather from two mutually opposed directions in sequence after one another.

In a preferred manner of carrying out the method, the first and second reaction gas mixtures (I, II) are composed of similar components, and the flow direction of the reaction gases is repeatedly reversed multiple times over the surfaces of the hollow structural element by respectively discontinuing and sequentially repeating the steps b) and c). This interval method especially has the advantage, in connection with inner surfaces that comprise protrusions and other obstacles, that reduced reaction effects, for example between the windward and leeward sides of the obstacle, can be counteracted. Another advantage is that higher flow velocities can be used since the windward and leeward side effects will compensate each other. In other words, the previously typical slow creeping velocities used for the throughflow of inner surfaces to avoid the formation of differences between the windward and leeward sides of obstacles, which can lead to a premature depletion of the reaction components, no longer need to be maintained, so that firstly the premature depletion of reaction components is overcome, and secondly a high uniformity of the preparation and/or the coating is achieved, which is especially provable in the case of coatings by measuring the coating thickness. Finally, the duration of the method is reduced with this variation of the method, if the same preparation and/or coating results are to be achieved as with typical methods or apparatus.

In a further preferred manner of carrying out the method, at least one of the reaction gas sources provides reaction gases, and preferably halogen-containing gases, that serve for cleaning the outer and inner surfaces. Among these halogen-containing gases, especially chlorine-containing or fluorine-containing gases have proved themselves suitable, which gases have an etching reaction effect on the surfaces to be cleaned.

The reaction gas sources do not always need to be of the same type. In the case of surface preparations, at least one of the reaction gas sources preferably supplies reaction gases that serve to reduce sulfide-based or oxide-based deposits on the outer and inner surfaces, whereby such reaction gases are preferably hydrogen-containing gases, which flow around the surfaces of the structural elements in a preferred direction, while a coating source of a different type is effective for providing a coating gas to flow in the opposite direction. Flushing gases for cleaning an apparatus, before treated structural elements are removed from the apparatus can also flow in a preferred direction around the surfaces in the reaction spaces, for example in order to drive poisonous components in the preferred direction. Furthermore, connection holes between outer and inner surfaces of the structural elements, as they are known as film cooling holes in turbine blades, can be kept clear of undesired deposits and undesired contaminants during a cool-down phase after a coating process, by means of an inert gas flowing through the structural elements in the direction of the second reaction gas mixture II, from inside to outside through the connection holes during the cool-down phase.

Consequently, the second reaction gas (II) can be a coating reaction gas, such as preferably a chromizing or aluminizing reaction gas, a reducing gas such as preferably a hydrogen-containing gas, or an inert gas. In this context, the inert gas is preferably used during the phase of heating-up or of cooling-down.

During a gas diffusion coating of the outer or inner surfaces, preferably halide-containing gases will be decomposed on the metallic outer or inner surfaces of the hollow structural elements, into a metallic component that is deposited as a coating onto the outer and inner surfaces, and a halogen component that can be reused as an activator. The depletion of the metal source and the thinning of the reaction gas is especially grave at the flow velocities of typical methods, and has a negative effect on the uniformalization of the layer thicknesses, which is overcome by the method according to the invention.

In order to be able to carry out the method according to the invention, and in order to overcome the disadvantages of the previous known apparatus, which are unsuitable for a mass production the invention further provides a special apparatus.

This apparatus is suitable for carrying out the preparation and/or coating of the surfaces of metallic hollow structural elements that comprise at least two connection openings between their outer and inner surfaces. The apparatus comprises a reaction vessel with an outer reaction space and a central holding pipe. Removable hollow support arms oriented radially relative to the holding pipe are arranged on the holding pipe. These support arms can each respectively receive at least one hollow structural element and typically carry up to thirty hollow structural elements, whereby a first connection opening of a respective structural element is connected to the outer reaction space and a second connection opening of the respective structural element is connected through the hollow support arm to the inner space of the holding pipe. The reaction gases from the outer reaction space first flow over the outer surfaces of the hollow structural elements and then flow through the first connection opening to the inner surfaces of the hollow structural elements. The reaction gases are guided through the second connection opening in the hollow structural elements and through the support arms into the inner space of the holding pipe. Oppositely, the reaction gases can flow from the inner space of the holding pipe via the support arms through the second connection opening of the structural element, and thus the reaction gases flow first over the inner surfaces of the structural element and thereafter through the first connection opening over the outer surfaces of the respective structural elements into the outer reaction space.

This apparatus has the advantage that it enables the gas to flow over the surfaces of the structural elements in two opposite directions in sequence after another, or in alternation. The hollow structural elements may be mounted on the removable support arms separately and outside of the reaction spaces. The hollow structural elements can comprise different structures and are individually fitted onto the support arms and are connected to the hollow support arms in a gas-tight manner by means of the second connection openings. A plurality of support arms are then connected onto the holding pipe via uniformly shaped connection openings. These connections can be embodied conically, spherically, in a flange configuration, or in a muff configuration. Preferably they are embodied as semispherical removable connections.

The support arms are finally secured onto the holding pipe in the manner of a branch onto a fir tree, whereby the branch and the tree trunk are hollow and the tree trunk can receive an inner reaction gas source therein, whereby the reaction gas source is advantageously separated from the outer reaction space, so that gas can flow over the surfaces of the hollow structural elements from opposite directions.

In a preferred embodiment of the apparatus according to the invention, outer granulate baskets with a first reaction gas source material are secured in the outer reaction space between the support arms, and are arranged radially relative to the holding pipe. Such reaction gas source materials are known for gas diffusion processes from U.S. Pat. No. 5,071,678, and comprise a halogen granulate that is in a gaseous form at high temperatures as an activator, a metal donor granulate, and ballast materials such as granular metal oxides. Advantageously, these are hung up in granulate baskets in the outer reaction space near the surfaces that are to be coated, whereby the granulate baskets are positioned between the support arms. In a further preferred embodiment of the invention, the granulate baskets are arranged along with the support arms in a plurality of layers above one another on the holding pipe. In this manner, advantageously, up to one thousand hollow structural elements can be coated on their outer and inner surfaces in a single charge or batch. Moreover, such an apparatus is expandable as desired and suitable for the mass production.

A second reaction gas source material is preferably arranged in the inner space of the holding pipe in inner granulate baskets. One advantage is that, for same-type source materials, the reaction gas flows from the sources over the surfaces of the structural elements from two directions and thereby windward and leeward effects taking place at obstructions and sharp edges at high flow velocities are substantially compensated. Moreover, different reaction source materials may also preferably be employed, so that, for example, chromium is predominantly deposited on the inner surfaces if the inner granulate baskets carry a chromium-containing reaction gas source, and a predominantly aluminum-containing coating results on the outer surfaces if the outer granulate baskets in the outer reaction space comprise an aluminum-containing donor granulate.

In order to ensure a reliable switching over of the gas flow directions, the holding pipe preferably stands centrally on the floor of the reaction vessel, and the reaction vessel floor comprises at least one first supply or exhaust outlet opening for the outer reaction space and at least one second supply or exhaust outlet opening for the inner space of the holding pipe.

BRIEF DESCRIPTION OF THE DRAWINGS

The following figures and examples explain preferred embodiments and application examples of the present invention.

DETAILED DESCRIPTION OF PREFERRED EXAMPLE EMBODIMENTS OF THE INVENTION

Figure 1:
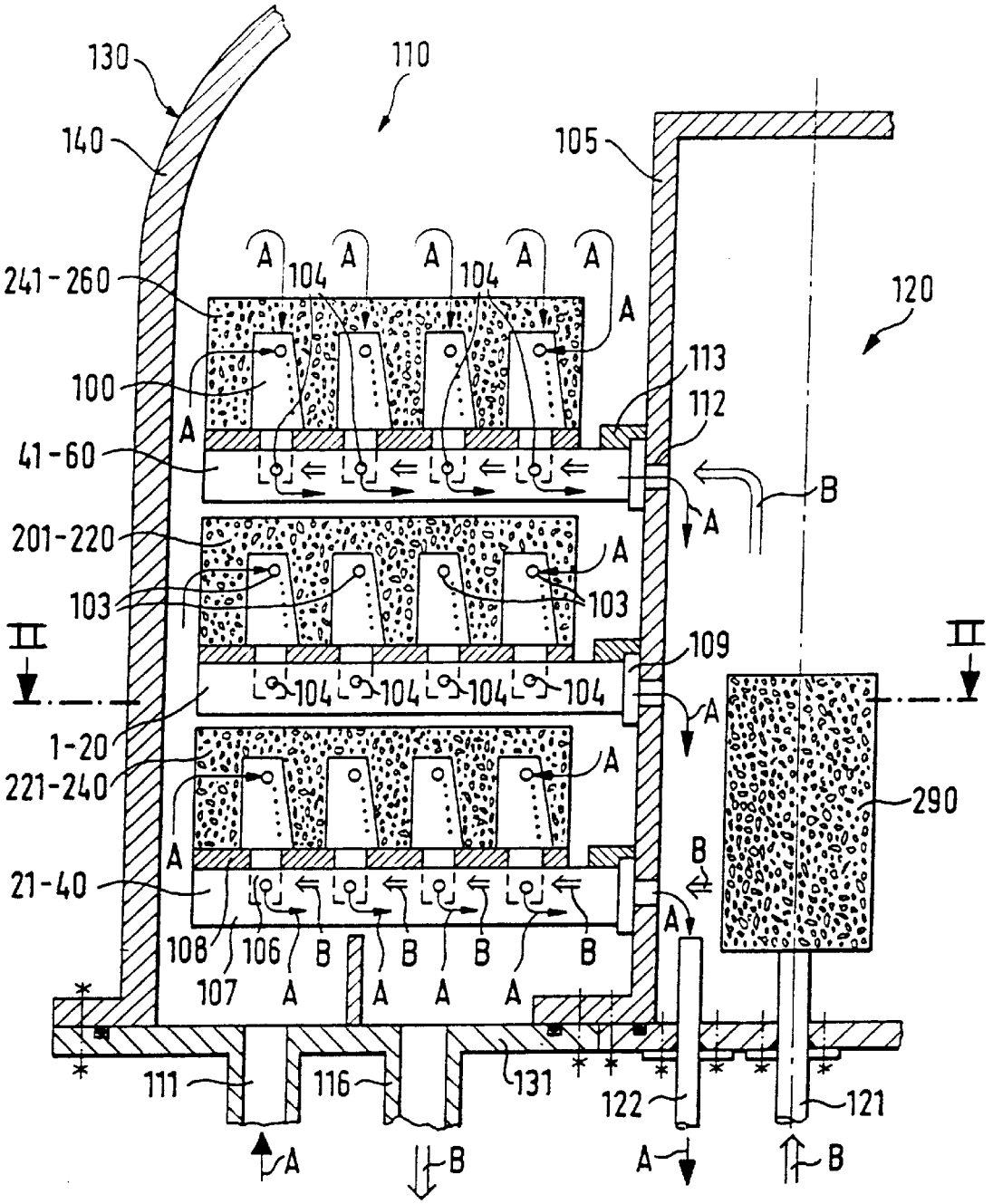
FIG. 1 shows a portion of an apparatus according to the invention for carrying out the method according to the invention.

FIG. 1 shows a portion of an apparatus according to the invention for carrying out the method according to the invention. For preparing and/or coating the surfaces of metallic hollow structural elements 100, these are arranged in support arms 1 to 60 so that the hollow structural elements 100 are located between two reaction gas sources 201 to 260 and 290. These reaction gas sources 201 to 260 and 290 prepare two reaction gas mixtures (I, II) for treating the outer and inner surfaces of the hollow structural elements 100, whereby a first reaction gas mixture (I) of the first reaction gas source 201 to 260 in an outer reaction space 110 is directed in the direction of arrow A over the outer surfaces and thereafter over the inner surfaces of the structural elements 100, and then a second reaction gas mixture (II) of the second reaction gas source 290 in a second reaction space 120 is directed in the direction of arrow B first over the inner surfaces and thereafter over the outer surfaces of the structural elements 100. The direction of the reaction gas flows can be varied multiple times between the flow directions A and B in a manner staggered in time, in order to compensate windward and leeward effects arising in the direction A or B on obstructions and sharp edges of the hollow structural elements 100 on the outer and inner surfaces of complexly configured structural elements 100.

One of the reaction gas sources can also be arranged in circuit before the outer or inner reaction space 110, 120, and can supply, through the supply openings 111 or 121 in the floor 131 of the reaction vessel, reaction gases such as halogen-containing gases that preferably serve for cleaning the outer and/or inner surfaces. Hydrogen-containing reducing gases are also supplied from external sources through the supply openings 111 or 121 to the outer and/or inner surfaces for reduction of sulfide-based or oxide-based deposits, whereby at least one of the two granulate basket arrangements, as shown by the positions 201 to 260 or the position 290 can be omitted.

For a gas diffusion coating of the outer or inner surfaces of the hollow structural elements 100, halide-containing gases are generated in the outer or inner reaction space 110 or 120. These reaction gases are partially decomposed on the metallic outer or inner surfaces of the hollow structural elements 100, into a metallic component, which is deposited as a coating onto the outer and inner surfaces, and a gaseous halogen component, which can be reused as an activator after it is condensed on cool surfaces or acts as an activator gas in heated spaces to transport donor metal atoms to the outer or inner surfaces of the hollow structural elements 100. In order to maintain the transport in the opposite directions A and B according to the invention, an inert carrier gas such as argon is typically necessary, whereby this carrier gas is directed in time succession respectively in the direction of arrow A or B over the outer or inner surfaces of the hollow structural elements 100 that are to be coated, and carries along the reaction gases.

The apparatus for preparing and/or coating the surfaces of metallic hollow structural elements 100 is only suitable for structural elements that comprise at least two connection openings 103, 104 between their outer and inner surfaces. A first connection opening 103 of the structural element 100 is connected to the outer reaction space 110. A second connection opening 104 is connected via the hollow support arm 1 to 60 to the inner space of a holding pipe 105, which simultaneously serves as an inner reaction space 120 in this example. Thereby, reaction gas of the first reaction gas source 201 to 260 can flow out of the outer reaction space 110, first over the outer surfaces and thereafter via the first connection opening 103 to the inner surfaces of the structural elements 100 and via the support arms 1 to 60 to the inner space of the holding pipe 105 in the direction of arrow A. Oppositely, reaction gas can flow from the inner space of the holding pipe 105 via the support arms 1 to 60 through the respective second connection opening 104 of structural element 100, first over the inner surfaces and thereafter through the first connection opening 103 over the outer surfaces of the respective structural element 100 into the outer reaction space 110 in the direction of arrow B.

To achieve this, the hollow structural elements 100 are respectively secured and sealed with their second connection opening 104 into the hollow support arm 1 to 60. This seal is achieved with a sealing mass 108 such as a sintered mass, whereby for example a bottom end 106 of the hollow structural element 100 with the second connection opening 104 projects into the hollow space 107 of the support arm 1 to 60, and is maintained free of the sealing mass 108 in the area of the opening. The hollow support arms are removably connected with the central holding pipe 105 so as to extend radially outwardly therefrom. The removable connection 109 comprises a conical, spherical, semispherical or flange-type seat 112, which comprises a pawl- or catch-type plug-in engagement device 113, which makes it possible to quickly hang the support arms 1 to 60 on the central hollow pipe 105.

Figure 2:
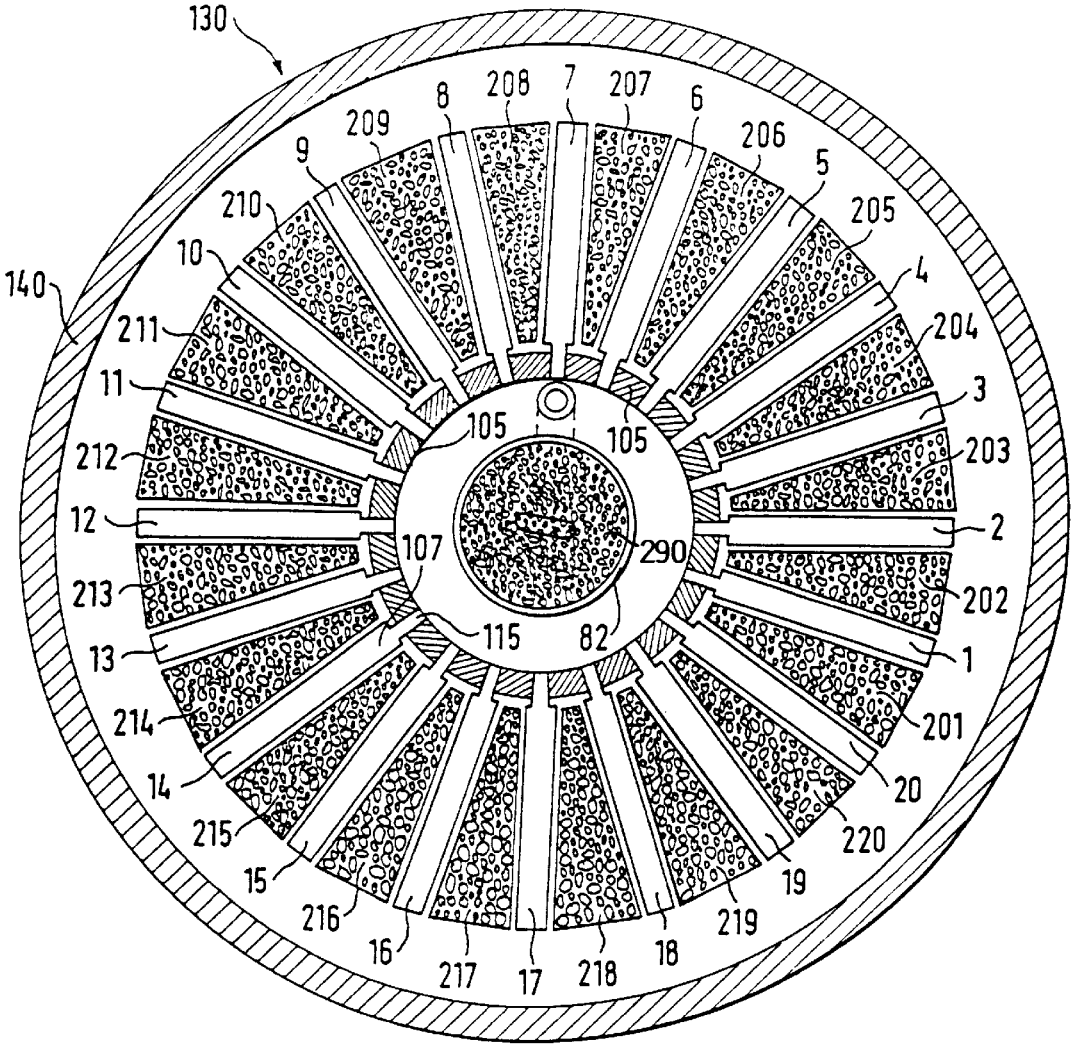
FIG. 2 shows a top plan view of one layer of granulate baskets and support arms of the apparatus according to the invention.

FIG. 2 shows a top plan view of a section plane II—II shown in FIG. 1 of one layer of granulate baskets 201 to 220 and support arms 1 to 20 of the apparatus according to the invention. The granulate baskets 201 to 260 with a first reaction gas source material, in this example are filled with donor granulate and activator granulate. In order to carry out a gas diffusion coating these baskets are hung into position between the support arms 1 to 20, and nearly completely surround the outer surfaces of the hollow structural elements 100 that are to be coated. These baskets first supply the outer surfaces of the hollow structural elements 100 with reaction gases.

A central granulate basket 290 with a second reaction gas source material in granular form is arranged in the center of the holding pipe 105. It first supplies the inner surfaces of the hollow structural elements 100 with reaction gases for a gas diffusion coating through the connection openings 115 to the hollow spaces 107 of the support arms 1 to 20 and through the second connection openings 104 in the hollow structural elements 100 as shown in FIG. 1. Thereafter, the reaction gases flow through the first connection opening 103 shown in FIG. 1 to the outer surfaces in the direction of arrow B.

Support arms 1 to 60 and granulate baskets 201 to 260 can be connected to or secured to the holding pipe 105 in a plurality of layers over one another, as shown in FIG. 1. In this example, three layers, which each respectively have twenty support arms 1 to 60 and twenty granulate baskets 201 to 260 are connected or secured onto the holding pipe 105. Each support arm in this example receives four hollow structural elements, so that two hundred and forty hollow structural elements 100 may simultaneously be cleaned and coated.

In addition to the supply openings in the outer reaction space 110 and in the inner reaction space 120, the floor 131 of the reaction vessel 130 comprises outlet openings 116 or 122 in the outer or inner reaction spaces 110 or 120. In order to switch around the flow direction A or B, the openings are connected via supply or outlet conduits, to corresponding control valves which are not shown, through which inert carrier gases or etching, reducing or deoxidizing reaction gases can be supplied or removed.

Figure 3:
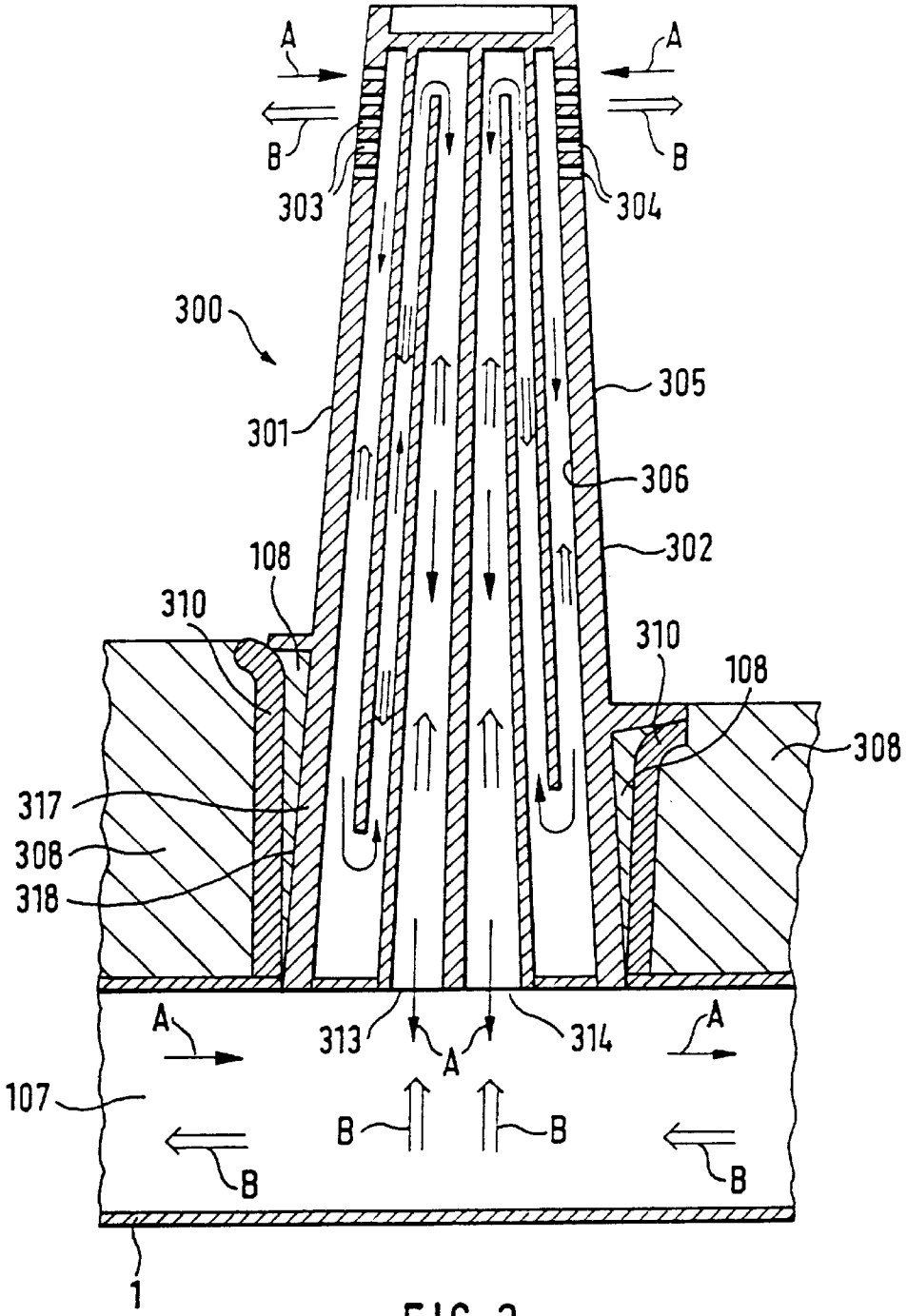
FIG. 3 shows one hollow blade that is suitable for use as a workpiece to be coated in the apparatus according to the invention and in the method according to the invention.

FIG. 3 shows a hollow blade 300 which is suitable for use as a workpiece to be processed in the apparatus according to the invention and in the method according to the invention. The hollow blade 300 is used in turbine engines and is to be protected against corrosion and oxygen embrittlement by the aggressive gases in the flow channel of the turbine engine. Typically, these hollow blades 300 have first connection holes 303 or 304 on their leading edges 301 and/or on their trailing edges 302, whereby these connection holes 303 or 304 connect the outer surfaces 305 with the inner surfaces 306. Additionally, these hollow blades 300 comprise a blade root 317 of which the outer surfaces 318 are to be protected against being coated. Second connection openings 313 and 314 are located in the blade root region. During operation, for example cooling air can enter through the second connection openings 313 and 314 and then flow out of the cooling film holes 303 or 304 as a cooling film on the leading and/or trailing edges 301 or 302. By using these openings, a cleaning and/or coating gas can flow along the surfaces of the blade 300, in sequence after one another in the direction A and in the direction B, by means of the apparatus according to the invention and by carrying out the method according to the invention, if the blade 300 is connected in a gas-tight manner onto a support arm 1 of the apparatus. In this example, the support arm consists of a hollow profile with a holding and supporting device 310 for the hollow blade 300 set onto the hollow profile, whereby the blade root 317 is plugged into the holding and supporting device 310 and then surrounded by a sealing mass 108, which is a sintered mass in this example, so that the openings 313 and 314 of the blade root 317 are connected with the hollow space 107 of the support arm 1.

The inner space of the hollow blade is structured in narrow channels, so that the reaction gases are multiply deflected and reversed, and windward and leeward effects could only be reduced by a minimal through-flow velocity. Only by switching the flow direction from the direction of arrow A to the direction of arrow B and vice versa, according to the invention, is it possible to compensate the windward and leeward effects at the sharp deflection points. A depletion of reaction components in the reaction gas sources is reduced and an enrichment of reaction components especially in the inner space of the hollow blade is achieved by the method according to the invention, so that it is possible to achieve more-uniform cleaning effects and more-uniform coating results than can be achieved with prior conventional apparatus and methods.

EXAMPLE 1

A high pressure turbine blade made of a nickel-based alloy having the composition (Rene 80)

| | | |
|---|---|---|
| Co | 9.0–10 | wt. % |
| Cr | 13.7–14.3 | wt. % |
| Ti | 4.8–5.2 | wt. % |
| Al | 2.8–3.2 | wt. % |
| W | 3.7–4.3 | wt. % |
| Mo | 3.7–4.3 | wt. % |
| Fe | max 0.35 | wt. % |

-continued

| | | |
|---|---|---|
| Hf | max 0.1 | wt. % |
| C | 0.15–0.19 | wt. % |
| Ni | Remainder | |

having a complex inner geometry, comprising 6 to 8 cooling air holes (see FIG. 3) is coated with an aluminum diffusion layer on the outer and inner surfaces using to the method according to the invention and the apparatus according to the invention.

To achieve this, the root area of the turbine blade 300 is first provided with an $Al_2O_3$ layer by being submerged into a slip suspension, which essentially consists of $Al_2O_3$ powder and a watery solution. After drying the $Al_2O_3$ slip, four blades 300 respectively are plugged onto holding and supporting devices 310 that are located on the support arms 1 to 60 of the apparatus according to the invention. Thereafter, each support arm 1 to 60 is filled up with a powder bulk material 308 of a nickel based powder and $Al_2O_3$ powder. This powder bulk material 308 seals the blade root area in cooperation with the slip cast layer 108 on the outer surfaces 318 of the blade root 317 in the holding and supporting device 310 by means of being sintered together into a sintered mass during the subsequent heating, and protects the outer surfaces 318 of the blade root 317 from being coated with a coating.

The support arms 1 to 60 which have been prepared in this manner i.e. with the turbine blades mounted thereon outside of the reaction vessel 130 are thereafter hung into the central holding pipe 105. The conical or semispherical shaped connection pins of the support arms are additionally brush-painted with $Al_2O_3$ slip in order to seal small gaps.

In this example, over thirty support arms in more than five layers or planes are hung into position on a holding pipe 105. Granulate baskets of perforated sheet metal are hung up between the support arms in each layer. These granulate baskets contain an aluminum donor granulate of an Al/Cr alloy as a reaction gas source, and contain a granulate of aluminum fluoride as an activator donor. In this example, 600 g of aluminum donor granulate and 10 g of activator granulate are used per blade. A portion of this granulate is filled into a granulate basket in the interior of the holding pipe as a second reaction gas source 290.

After hanging the support arms and the granulate baskets into position on the holding pipe, a fir tree charging carrier is prepared. The fir tree charging carrier is positioned on the pedestal or understructure of a bell- or hood-type retort furnace, whereby the holding pipe 105 forms the central trunk of the fir tree charging carrier. The central trunk has a supply conduit 121 and an outlet conduit 122 passing through the retort pedestal or understructure. In this example, the outer reaction space has two supply conduits 111 and two outlet conduits 116. A retort hood or bell 140 and a hood-type furnace which is not shown are tilted or inverted over the fir tree charging carrier and the retort is flushed with argon.

During the heating, a throughflow of 4000 l/h of Ar is flushed through the opening 122 opposite the direction of arrow A through the fir tree trunk via the hollow structural elements and into the first reaction space 110, i.e. the retort space. Upon reaching a holding temperature of 1050° C., the throughflow is switched-over, and a carrier gas amount of 40 l/h of $H_2$ is pumped from the retort space in the direction of arrow A into the fir tree trunk. After a holding time of 4 h, the gas flow is directed in the reversed direction B through the opening 121 into the system, so that for the time being, by means of the reaction gas source 290, an $H_2$ gas flow of 40 l/h flows for two more hours, but now in the direction B. For cooling down, Ar as an inert gas is finally supplied to the opening 122 opposite the flow direction A.

The result is an extremely uniform coating of the outer and inner surfaces 305, 306 of the turbine blades, with an aluminum content of over 30 wt. % in the protective layer.

EXAMPLE 2

This example involves carrying out a combined pre-cleaning of the inner surfaces of a turbine blade, with a subsequent coating of the outer and inner surfaces of a turbine blade with similar material as in example 1.

Such internal cleanings can become necessary, because only the outer surfaces can be reliably freed of form residues and reaction products between the blade material and the form material using typical cleaning processes. Due to reactions of the inner surfaces with the form material during the casting of a blade, partial residues can remain on the inner surfaces, which will hinder or completely prevent a diffusion coating, so that weak locations can arise in the hot gas oxidation and corrosion protective layer in the interior of the hollow blades 300.

In this example, a turbine blade made of a nickel-base alloy of the composition (Rene 142)

| | | |
|---|---|---|
| Co | 11.45–12.05 | wt. % |
| Cr | 6.6–7.0 | wt. % |
| Ti | max. 0.02 | wt. % |
| Al | 5.94–6.3 | wt. % |
| W | 4.7–5.1 | wt. % |
| Mo | 1.3–1.7 | wt. % |
| Fe | max. 0.2 | wt. % |
| Hf | 1.3–1.7 | wt. % |
| C | 0.1–0.14 | wt. % |
| Re | 2.6–3.0 | wt. % |
| Ni | remainder | |

is cleaned and coated.

In order to achieve this, the cast material is cleaned and coated at the same process temperature, so that the cleaned inner surfaces cannot again become coated with oxide.

Respectively five turbine blades per support arm are connected to the central holding pipe, and a charge of 300 rotor blades are distributed in three layers. A retort bell and furnace hood are inverted or tilted over the fir tree charge, and an argon-shielding atmosphere is produced by means of pumping-down and flushing. The argon-throughflow amounts to 2000 l/h during the flushing.

Thereafter, the retort is heated to 750° C. to 1040° C. under argon. During this, an $H_2$ throughflow of 4000 l/h flows opposite the direction A through the opening 122 first along the inner surfaces of the hollow blade and subsequently over the outer surfaces of the hollow blade.

After reaching a holding temperature of 1040° C., a mixture of HF and $H_2$ is introduced into the fir tree through the opening 122 for a duration of 2 h. The reaction gas mixture comprises HF of 0.5 l/h per blade, and $H_2$ of 5 l/h per blade. Simultaneously, hydrogen circulates in the outer reaction space at a rate of 40 l/h per blade, whereby this hydrogen is introduced through the opening 111 and is removed through the opening 116. Thereby a pressure relationship is maintained so that the process pressure in the first reaction space or in the retort space is 5 to 30 hPa below the process pressure in the holding pipe or distributor trunk. The reaction atmospheres of the inner and outer reaction spaces are removed together through the opening 116 in the first reaction space, with a closed opening 121.

After completion of a 2 hour holding time, the HF supply is switched off and a flushing with $H_2$ (5 l/h per blade) is carried out for a further 0.25 hours. Thereafter the gas flow is reversed. Now, to carry out the coating, a reaction gas mixture of AlF, $AlF_3$ and $H_2$ (at 20 l/h per blade) is directed in the direction A, first over the outer and then over the inner surfaces of the hollow blades. After a holding time of 4 h at 1040° C., the coating is carried out in the opposite direction B for two further hours. Thereby the reaction gas is directed from the inner reaction gas source through the support arms via the second connection openings in the hollow blades, first over the inner surfaces, and is thereafter conveyed over the outer surfaces. While cooling-down the charge, the charge is flushed with Ar opposite the flow direction A, with a closed opening 121, whereby the argon flows via the opening 122, first over the inner surfaces of the hollow blades and next over the outer surfaces of the hollow blades.

The result is a defect-free inner coating with high uniformity of the inner layer thickness.

EXAMPLE 3

Example 3 involves coating the inside and the outside of a hollow blade that comprises an extreme length of over 500 mm of the inner cooling channels.

Using the previously available methods and apparatus having a unidirectional reaction gas guidance, results in especially grave reductions of the inner layer thickness from the entry of the reaction gases into the hollow spaces or cooling channels of hollow blades up to the outlet out of the hollow spaces or up to the end of the cooling channels. Reductions of 0.5 to 1 $\mu$m per centimeter of channel length are generally typical. With a coating thickness of 50 $\mu$m in the area of the first connection opening 103 to the inner space of a hollow blade, the coating thickness tapers to zero at the end of a channel having a length of 500 cm. In contrast thereto, with the new apparatus and the method according to the invention, it is possible both to coat longer cooling channels as well as to better uniformalize the layer thicknesses.

In this example, the first reaction gas source is provided with a granulate of an aluminum donor alloy and the second reaction source is provided with a donor alloy and the granulate of a halogen activator. During the heating phase, the apparatus is heated up to 1040° C. under a low argon throughflow in the direction of arrow A, until the entire activator is present in a gaseous state in the second reaction space. Only thereafter, the throughflow is controlled in such a manner for one half of an hour so that the reaction gases flow in the direction B. During this time period, sufficient activator gas flows over the inner surfaces of the structural elements into the first reaction space, to form a reaction gas through reaction with the donor metal granulate, which after 30 minutes, flows in the opposite direction along arrows A first over the outer surfaces, and thereafter coats the inner surfaces. This reversal of the throughflow direction is carried out every 30 minutes for the next 5 hours. Finally, by means of argon with a throughflow of 40 l/h per blade, the activator gas is displaced into the second reaction space, where it is condensed or precipitated. This has the advantage, that no poisonous vagabond or stray halogen-containing or halide-containing compounds or gases are present in the outer reaction space, which is often frequented for the assembly and disassembly. Instead, these halogen-containing or halide-containing compounds or gases are concentrated on the inner second reaction space.

With this variation of the method, it was possible to further increase the uniformalization of the coating thickness.

EXAMPLE 4

Next, the method according to the invention is used for coating problematic superalloys, on which it is difficult or impossible to apply aluminum by means of gas diffusion coating of a conventional type. These alloys include cobalt based alloys and nickel based alloys with a high tungsten content.

In order to solve the coating problems, it is necessary to have a high content of aluminum halides in the reaction gas, which is designated as the aluminum activity. The depletion of aluminum halides in the reaction gas, and therewith the reduction in the aluminum activity is, however, considerable in the conventional methods due to the precipitation of aluminum on the surfaces of the hollow structural elements. With the method according to the invention, this depletion is reduced, so that a high aluminum activity can be maintained and thereby it is possible to satisfactorily coat, even from the inside, problematic superalloys, onto which it is difficult or impossible to apply aluminum by means of gas diffusion coating of a conventional type.

As an example, turbine guide blades having the following alloy composition (X 40)

| | | |
|---|---|---|
| Ni | 9.5–11.5 | wt. % |
| Cr | 24.5–26.5 | wt. % |
| Al | max. 0.35 | wt. % |
| W | 7.0–8.0 | wt. % |
| Fe | max. 2.0 | wt. % |
| C | 0.45–0.55 | wt. % |
| Co | Remainder | |

and turbine rotor or running blades having the following composition (Mar-M237 LC)

| | | |
|---|---|---|
| Co | 9.0–11.0 | wt. % |
| Cr | 6–8.0 | wt. % |
| Ti | 0.9–1.2 | wt. % |
| Al | 5.4–5.7 | wt. % |
| W | 3.8–10.2 | wt. % |
| Mo | 0.6–0.8 | wt. % |
| Hf | 1.0–1.6 | wt. % |
| C | 0.05–0.14 | wt. % |
| Ta | 2.9–3.1 | wt. % |
| Ni | Remainder | |

were coated using a high Al activity.

In order to achieve this, 100 hollow blades are arranged in five layers in the first reaction space and 1500 g per blade of donor metal granulate as well as 20 g of activator granulate per blade are weighed in. A retort hood or bell 140 of 1.3 $m^3$ volume capacity is tilted over the charge. The retort floor 131 has one gas supply line and two gas outlet lines. The holding pipe comprises a cylindrical container having a volume capacity of 0.25 $cm^3$ in the lower region, above the retort floor in the heated region.

Before being heated, the charge is flushed in the direction B with argon of ten times the volume of the volume capacity of the retort hood or bell. Thereafter, the apparatus is heated up under an argon throughflow of 1000 l/h. At 900° C. it is switched over to a hydrogen throughflow of 2000 l/h, until a holding temperature of 1080° C. is reached. Then the throughflow is reduced and switched over to a pressure regulation. For this variant of the method, pressure sensors are arranged as measured value transducers in the first and second reaction spaces. A pressure difference between the pressure sensors is built up, alternatingly with a hydrogen throughflow up to approximately 1000 l/h.

After several alternations of the sign of the pressure difference between the two reaction spaces 110 and 120, after 6 hours, the charge is cooled down under argon flushing in direction B.

As a result, a very uniform layer thickness between the outer and inner surfaces of the hollow blades is determined.

EXAMPLE 5

In this example, a turbine rotor or running blade for a stationary gas turbine made of the same material as in Example 1 is to be coated essentially with chromium on the inner surfaces and essentially with aluminum on the outer surfaces.

The running or rotor blades are equipped with film cooling holes on the outlet or trailing edges, for the operating temperatures of a stationary gas turbine. Furthermore, the running or rotor blades comprise three internal cooling channels. It has been proved to be advantageous to coat the inner channels with a different material than the outer surfaces of the hollow blades. For this reason, the inner channels are to be coated with chromium and the outer surfaces are to be coated with aluminum.

In order to achieve such a coating with conventional unidirectional methods, it is necessary to carry out a high effort in relation to protective, temporary cover layers.

These running or rotor blades can be coated in an substantially more economical manner with the method according to the invention and the new apparatus.

For example, 160 turbine blades in four layers are connected to twenty support arms, in each layer whereby each support arm receives two blades. In the second inner reaction space, 10 kg of chromium tablets are arranged in perforated sheet metal baskets and per blade 5 g of $NH_4Cl$ are positioned in the bottom region of the holding pipe. A further proportion of 3 g of $NH_4Cl$ is arranged in the floor region of the first reaction space.

The aluminum donor granulate with a fluorine compound as an activator for the outer coating is placed into the granulate baskets between the support arms at 400 g per blade. The charge is flushed with argon, and is heated up to a first holding temperature of 1080° C. without any throughflow. At 1080° C. an argon throughflow of 160 l/h in direction B over the blade inner surfaces is switched on, whereby this argon throughflow coats the inner surfaces with chromium. Simultaneously, an argon flow of 4000 l/h, which protects the outer surfaces against a chromium coating circulates through the inlet 111 and the outlet 116 in the first reaction space.

The quantity and the location of the $NH_4Cl$ activator for the aluminizing are dimensioned or selected in such a manner that the $NH_4Cl$ activator is completely evaporated during four hours, at the prevailing temperature distribution and the existing temperature gradient. After four hours, the argon flow is switched over to an aluminizing of the outer surfaces. At a temperature of 1040° C. and an argon throughflow of 400 l/h in direction A, the outer surfaces are aluminized during the following four hours.

After cooling-down the charge to room temperature under an argon throughflow in direction B, a measured average inner coating thickness of 25 $\mu$m results, which essentially consists of chromium, and an aluminizing layer results on the outer surfaces with an average thickness of 45 $\mu$m.

What is claimed is:

1. A method of treating inner surfaces and outer surfaces of metallic hollow structural elements, comprising the following steps:

a) preparing a first reaction gas mixture;

b) flowing said first reaction gas mixture in sequence along said outer surfaces and then along said inner surfaces of said structural elements, and then ceasing said flowing of said first reaction gas mixture;

c) preparing a second reaction gas mixture; and d) at a time other than during said step b), flowing said second reaction gas mixture in sequence along said inner surfaces and then along said outer surfaces of said structural elements, and then ceasing said flowing of said second reaction gas mixture.

2. The method according to claim 1, wherein said step b) is carried out before said step d).

3. The method according to claim 1, wherein said step d) is carried out before said step b).

4. The method according to claim 1, further comprising repeating said steps b) and d) alternately in succession a plural number of times.

5. The method according to claim 1, wherein said step a) comprises preparing said first reaction gas mixture in a first reaction gas source, and said step c) comprises preparing said second reaction gas mixture in a second reaction gas source distinct from said first reaction gas source.

6. The method according to claim 5, wherein said first and second reaction gas sources respectively have different compositions.

7. The method according to claim 5, wherein said first and second reaction gas sources respectively have the same composition.

8. The method according to claim 1, wherein said steps a) and c) are carried out so that said first and second reaction gas mixtures comprise the same constituent components as each other respectively.

9. The method according to claim 1, wherein steps a) and c) are carried out so that said first and second reaction gas mixtures respectively have different constituent components relative to one another.

10. The method according to claim 1, wherein said flowing of said first reaction gas mixture in said step b) is carried out in a first flow direction along said inner surfaces of said structural elements, wherein said flowing of said second reaction gas mixture in said step d) is carried out in a second flow direction along said inner surfaces of said structural elements, and wherein said first flow direction and said second flow direction are respectively opposite one another.

11. The method according to claim 1, wherein at least one of said first and second reaction gas mixtures cleans said inner and outer surfaces as said one of said gas mixtures flows along said inner and outer surfaces.

12. The method according to claim 11, wherein said at least one of said gas mixtures contains a halogen.

13. The method according to claim 1, wherein at least one of said first and second reaction gas mixtures reduces at least one of sulfide-based deposits and oxide-based deposits present on at least one of said inner and outer surfaces as said one of said gas mixtures flows along said inner and outer surfaces.

14. The method according to claim 13, wherein said at least one of said gas mixtures contains hydrogen.

15. The method according to claim 1, wherein said first and second reaction gas mixtures respectively contain at least one metal halide, wherein said at least one metal halide decomposes into at least one metallic component and at least one halogen component during said flowing of said first and second reaction gas mixtures along said inner and outer surfaces, and wherein said at least one metallic component is deposited as at least one metallic coating on said inner and outer surfaces during said flowing of said first and second reaction gas mixtures along said inner and outer surfaces, and further comprising recirculating and reusing said at least one halogen component as an activator.

16. The method according to claim 1, wherein said structural elements comprise a cobalt-based alloy forming said inner and outer surfaces, said first and second reaction gas mixtures respectively comprise an aluminum halide gas, and said steps b) and d) result in the formation of an aluminized coating on said inner and outer surfaces.

17. A method of coating an inner surface of a metallic hollow structural element, comprising the following steps:

a) preparing a first coating gas;

b) flowing said first coating gas through a hollow interior of said structural element along said inner surface in a first flow direction, while reacting said first coating gas so as to deposit a first coating on said inner surface, and then ceasing said flowing of said first coating gas;

c) preparing a second coating gas; and d) after completion of said step b), flowing said second coating gas through said hollow interior of said structural element along said inner surface in a second flow direction opposite said first flow direction, while reacting said second coating gas so as to deposit a second coating on said inner surface, and then ceasing said flowing of said second coating gas.

18. An apparatus for treating inner surfaces and outer surfaces of metallic hollow structural elements that have at least first and second connection openings respectively extending between said inner and outer surfaces, wherein said apparatus comprises:

a reaction vessel enclosing an outer reaction space therein;

a central holding pipe arranged in said reaction vessel and enclosing an inner space therein; and a plurality of hollow support arms removably mounted on said central holding pipe so that said support arms respectively extend radially outwardly from said central holding pipe and so that a hollow interior of each said support arm communicates with said inner space in said central holding pipe;

wherein each said support arm has at least one gas flow hole therein communicating with said hollow interior of said support arm;

wherein each said support arm is adapted to have at least one of said hollow structural elements mounted thereon with said second connection opening connected to said gas flow hole of said support arm and communicating with said interior space in said central holding pipe through said hollow interior of said support arm, and said first connection opening communicating with said outer reaction space; and wherein said apparatus is so arranged and adapted so that a gas can flow from said outer reaction space in sequence over said outer surfaces, through said first connection openings, along said inner surfaces, through said second connection openings, through said gas flow holes, through said hollow interiors and into said inner space, and so that a gas can flow from said inner space in sequence through said hollow interiors, through said gas flow holes, through said second connection openings, along said inner surfaces, through said first connection openings, and over said outer surfaces into said outer reaction space.

19. The apparatus according to claim 18, further comprising outer granulate baskets containing a granular first reaction gas source material, wherein said outer granulate baskets are arranged in said outer reaction space respectively between neighboring ones of said support arms and respectively extending radially relative to said central holding pipe.

20. The apparatus according to claim 19, wherein said support arms and said outer granulate baskets together are arranged on plural layers one above another in said outer reaction space, and are connected to said holding pipe.

21. The apparatus according to claim 19, further comprising inner granulate baskets containing a granular second reaction gas source material, arranged in said inner space in said holding pipe.

22. The apparatus according to claim 18, further comprising inner granulate baskets containing a granular second reaction gas source material, arranged in said inner space in said holding pipe.

23. The apparatus according to claim 18, wherein said reaction vessel comprises a floor and a retort arranged on said floor, and said holding pipe is arranged standing on said floor centrally in said reaction vessel, and further comprising a first outer gas conduit passing through said floor into said outer reaction space and a first inner gas conduit passing through said floor into said inner space.

24. The apparatus according to claim 23, further comprising a second outer gas conduit passing through said floor into said outer reaction space, and a second inner gas conduit passing through said floor into said inner space.

25. The apparatus according to claim 24, further comprising a basket containing a granular reaction gas source material arranged in said inner space in said holding pipe, wherein said first inner gas conduit communicates directly into said basket and said second inner gas conduit communicates into said inner space outside of said basket.

26. The apparatus according to claim 18, wherein each said support arm has a plurality of gas flow holes distributed along a radial extending length of said support arm, and is adapted to receive a plurality of said structural elements mounted thereon.

* * * * *